US005377438A

United States Patent [19]

Sheinfeld et al.

[11] Patent Number: 5,377,438

[45] Date of Patent: Jan. 3, 1995

[54] DEVICE FOR PREVENTING ACCIDENTAL DISCHARGING OF A BULLET FROM A FIREARM

[75] Inventors: Naftali Sheinfeld; Michael Cohen, both of Mobile Post North Yehuda, Israel

[73] Assignee: Etzion Metal Works, Israel

[21] Appl. No.: 135,738

[22] Filed: Oct. 13, 1993

[30] Foreign Application Priority Data

Oct. 25, 1992 [IL] Israel ..... 103539

[51] Int. Cl.[6] ..... F41A 21/32; F41A 35/04

[52] U.S. Cl. ..... 42/96; 42/106; 89/14.5

[58] Field of Search ..... 42/96, 106, 105; 102/485, 484; 89/14.5

[56] References Cited

U.S. PATENT DOCUMENTS

| | | | |
|---|---|---|---|
| 3,243,909 | 4/1966 | Kotikov | 42/105 |
| 3,664,263 | 5/1972 | Driscoll | 102/485 |
| 3,690,026 | 9/1972 | Rose | 42/105 |
| 3,934,513 | 1/1976 | Gabriëls | 102/485 |
| 4,448,129 | 5/1984 | Gabriels | 102/484 |
| 4,829,877 | 5/1989 | Zerega | 89/14.5 |

*Primary Examiner*—David Brown

*Attorney, Agent, or Firm*—Poms, Smith, Lande & Rose

[57] ABSTRACT

A device for preventing the accidental discharge of a bullet from a firearm, including an attachment adapted to engage the muzzle end of a firearm barrel, a tubular body coaxially attachable with one of its ends to the barrel via the attachment, the bore of the tubular body is provided with an abutment, a stopper fixedly attachable to the other end of the body and having a central bore of a diameter exceeding the calibre of the firearm, an impact disk slidably disposed in the bore of the tubular body, and energy-absorbing and storing element interposed in the bore between the impact disk and the stopper. Upon the discharge of a bullet, the latter pierces the impact disk while transferring some of its kinetic energy to the energy-absorbing and storing element, causing the bullet to disintegrate into small particles escaping through the bore in the stopper.

2 Claims, 1 Drawing Sheet

DEVICE FOR PREVENTING ACCIDENTAL DISCHARGING OF A BULLET FROM A FIREARM

Figure 1:
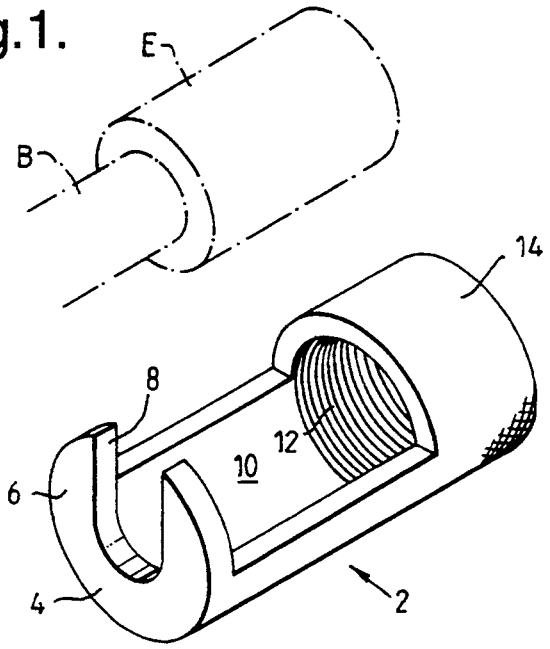

The present invention relates to a device for preventing the accidental discharging of a bullet from a firearm.

The problem of firearm-caused accidents due to the accidental discharge of bullets is a serious one, particularly in the armed forces, and has found no real solution beyond exhortatory and disciplinary efforts, the effects of which are unfortunately rather limited. The basic cause of these accidents is obviously the "cartridge in the chamber", which devolves the entire responsibility upon the slender shoulders of the safety catch that, under field conditions, cannot always be relied upon. Still, while under ordinary circumstances such as basic training and routine guard duties, the "cartridge in the chamber" is regarded as a serious breach of discipline, the loaded chamber cannot be avoided in certain security operations such as patrolling in hostile territory and the like.

It is one of the objects of the present invention to offer a solution to the above problem by providing a device attachable to every type of personal firearm, single-shot, semi-automatic and automatic, that, upon an accidental discharge occurring, will cause the bullet to be disintegrated into small, harmless fragments, yet will not interfere with subsequent bullets which can be fired without interference, until the device is "reset" by replacement of one of its components.

According to the invention, this is achieved by providing a device for preventing the accidental discharge of a bullet from a firearm, comprising attachment means adapted to engage the muzzle end of a firearm barrel, a substantially tubular body coaxially attachable with one of its ends to said barrel via said attachment means, the bore of said tubular body being provided close to said one of its ends with abutment means, a stopper fixedly attachable to the other end of said body and having a central bore of a diameter exceeding the calibre of said firearm, an impact disk slidably disposed in the bore of said tubular body, and energy-absorbing and storing means interposed in said bore between said impact disk and said stopper, and acting on said impact disk to maintain contact with said abutment means inside said body, wherein upon the discharge of a bullet, the latter pierces said impact disk while transferring some of its kinetic energy to said energy-absorbing and storing means, accomplishing which, said bullet disintegrates into small particles escaping through said bore in said stopper.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 2:
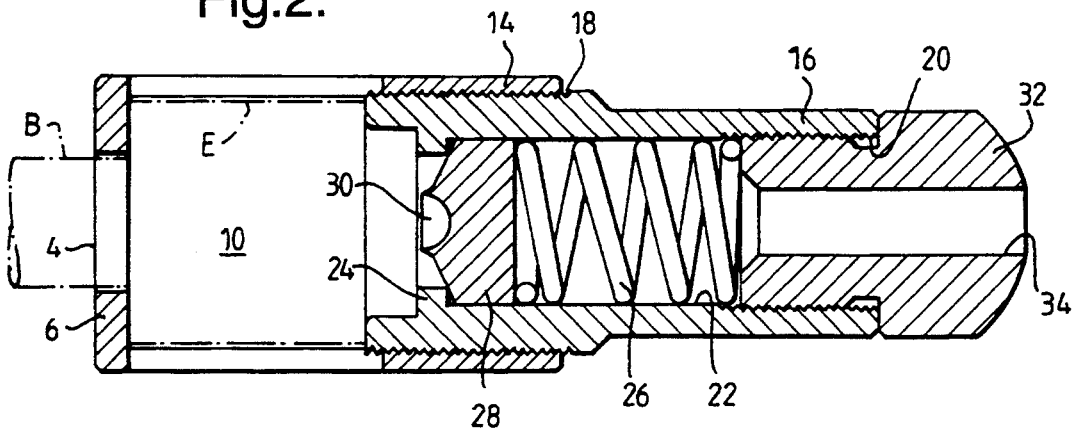

In the drawings:

FIG. 1 is a perspective view of the clasping sleeve used for attaching the device to the muzzle end of a firearm barrel, and FIG. 2 is a cross-sectional view of the device as attached to a rifle barrel.

Referring now to the drawings, there is seen in FIG. 1 the cradle-like clasping sleeve 2 about to be attached to the muzzle end of a rifle barrel B. The sleeve 2 is seen to consist of an end plate 4 having two prongs 6 formed by a slot 8 into which fits the rifle barrel B. Beyond the end plate 4, the sleeve 2 is cut open, forming a cradle 10 of a width and length adapted to accommodate the heavier cylindrical end piece E of the barrel B. Seen is also an internal thread 12 inside the other, uncut end 14 of the clasping sleeve 2. The end 14 is also advantageously knurled for a better grip when the device is attached to, or removed from, the barrel B in the manner to be explained further below.

FIG. 2 illustrates the entire device as attached to the rifle barrel B. There is seen a tubular body 16 having an external thread 18 on one of its ends, and an internal thread 20 on the other. The bore 22 inside the body 16 is provided with a shoulder-like abutment 24 against which is pressed, by means of a helical compression spring 26, an impact disk 28. The disk surface which faces the rifle muzzle is slightly tapering and, at its center, that is, in alignment with the axis of the rifle bore, is provided with a substantially hemispherical recess 30. The spring 26, one end of which presses against the disk 28, bears with its other end against a stopper 32, screwed into the internal thread 20 of the body 16 and having a central bore 34 of a diameter at least somewhat exceeding the calibre of the firearm the device is to be used with.

The body 16 is advantageously provided with a knurled region to facilitate rotation relative to the clasping sleeve 2 and the stopper 32 is provided with two flats for gripping with the aid of a spanner for unscrewing it from, or tightening it against, the body 16.

For attaching the device to a rifle barrel, one proceeds as follows:

By unscrewing, the body 16 is at least partly withdrawn from the clasping sleeve 2, which is then brought against the muzzle region from below, so that the barrel B enters the slot 8 of the sleeve 2 (see FIG. 1) and the cylindrical end piece E enters the cradle 10 (as shown in dash-dotted lines in FIG. 2). The body 16 is then screwed home again, until the cylindrical end piece E is firmly clasped or clamped between the end plate 4 and its prongs 6 on the one hand, and the front end of the body 2, on the other.

When, with the device in position, a bullet is fired, whether accidentally or intentionally, it will hit the bottom of the recess 30 of the impact disk 28 and, while compressing the spring 26, will pierce the disk 28, punching out a hole at least as large as the bullet calibre. It was surprisingly found that while doing so, the bullet totally disintegrates, dissolving into small fragments which harmlessly escape through the bore 34 of the stopper 32, with the re-expanding spring 26 returning the pierced disk 28 to the abutment shoulder 24.

It will be appreciated that since, prior to its disintegration, the bullet, as stated above, punches out a hole in the impact disk 28, it is possible to immediately fire the weapon again, should the need arise, as the second and any following bullet freely passes through that hole, as well as through the helical spring 26 and the bore 34 of the stopper 32.

To make the device "safe" again, all that has to be done is to unscrew the stopper 32, remove the spring 26 and the pierced impact disk 28, and replace the latter by a new, unpierced impact disk 28. The spring 26 is then returned and the stopper 32 tightly closed.

To remove the device from the firearm, the body 16 is unscrewed for a few turns until the cylindrical end piece 14 is no longer clasped between the end plate 4 and its prongs 6, and the body 16 of the device. The latter then simply drops off the muzzle.

The device is also helpful for the use, in automatic, gas or recoil-operated rifles, of blank cartridges often used for assault-training or ceremonial purposes. Whereas today, after firing a blank cartridge, such rifles have to be re-cocked for extraction of the spent cartridge and the introduction, into the chamber, of a new blank cartridge, the device, by effectively obturating the muzzle end of the barrel, provides the gas pressure required for operating the ejector and cocking mechanism, thus facilitating the firing, in succession and without need for re-cocking, of a plurality of blank cartridges.

It will be understood that the dimensions of the various components of the device, especially the dimensions and shape of the clasping sleeve 2, must be adapted to the particular type of weapon the device is intended for.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A device for preventing the accidental discharge of a bullet from a firearm, comprising:

attachment means adapted to engage the muzzle end of a firearm barrel;

a substantially tubular body coaxially attachable with one of its ends to said barrel via said attachment means, the bore of said tubular body being provided close to said one of its ends with abutment means;

a stopper fixedly attachable to the other end of said body and having a central bore of a diameter exceeding the calibre of said firearm;

an impact disk slidably disposed in the bore of said tubular body, and energy-absorbing and storing means interposed in said bore between said impact disk and said stopper, and acting on said impact disk to maintain contact with said abutment means inside said body, wherein upon the discharge of a bullet, the latter pierces said impact disk while transferring some of its kinetic energy to said energy-absorbing and storing means, accomplishing which, said bullet disintegrates into small particles escaping through said bore in said stopper.

2. The device as claimed in claim 1, wherein said energy-absorbing and storing means is a helical compression spring freely fitting said bore in said body and having an internal diameter exceeding the calibre of said bullet.

* * * * *